US008340329B2

(12) United States Patent
Ogura et al.

(10) Patent No.: US 8,340,329 B2
(45) Date of Patent: Dec. 25, 2012

(54) PIEZOELECTRIC SPEAKER

(75) Inventors: Takashi Ogura, Kanagawa (JP); Tatsuhiko Tokuda, Kanagawa (JP)

(73) Assignee: Panasonic Corporation, Osaka (JP)

( * ) Notice: Subject to any disclaimer, the term of this patent is extended or adjusted under 35 U.S.C. 154(b) by 266 days.

(21) Appl. No.: 12/863,574

(22) PCT Filed: Feb. 2, 2009

(86) PCT No.: PCT/JP2009/000393

§ 371 (c)(1),
(2), (4) Date: Jul. 19, 2010

(87) PCT Pub. No.: WO2009/098859

PCT Pub. Date: Aug. 13, 2009

(65) Prior Publication Data

US 2010/0290650 A1 Nov. 18, 2010

(30) Foreign Application Priority Data

Feb. 7, 2008 (JP) ..... 2008-027570

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 9/00* | (2006.01) |
| *H04R 11/00* | (2006.01) |

(52) U.S. Cl. ..... 381/190; 343/720; 455/350; 455/575.7; 455/562.1; 455/274

(58) Field of Classification Search ..... 381/190; 343/720; 455/350, 575.7, 562.1, 274
See application file for complete search history.

(56) References Cited

U.S. PATENT DOCUMENTS 4,352,961 A * 10/1982 Kumada et al. ..... 455/350
(Continued)

FOREIGN PATENT DOCUMENTS

JP 1-115347 U 8/1989
(Continued)

OTHER PUBLICATIONS

International Search Report for PCT/JP2009/000393 Mailed May 19, 2009 (5 Pages) (4 Pages English Translation).

*Primary Examiner* — Edgardo San Martin
(74) *Attorney, Agent, or Firm* — Seed IP Law Group PLLC

(57) ABSTRACT

A purpose of the invention is to provide a piezoelectric speaker that can serve as an antenna and can be used for frequencies in the MHz band, thereby it is possible to suppress enlarging of the size due to use of the piezoelectric speaker also as the antenna to a minimum level. The antenna (4) is provided on a frame (2*a*) that is a peripheral edge portion of the diaphragm (2). With this configuration, enlarging of the size can be suppressed to a minimum level while using the piezoelectric speaker also as the antenna, and it is possible to achieve space saving in a miniature electronic apparatus such as a mobile phone or the like when the piezoelectric speaker is adopted to the miniature electronic apparatus. In addition, the antenna (4) is a loop antenna formed in a loop shape. With this configuration, the piezoelectric speaker can be used for frequencies in the MHz band, which is used in, for example, a noncontact IC card technology. Further, a magnetic material sheet (5) is provided on the other face of the frame (2*a*) so as to oppose to the antenna (4). With this configuration, it is possible to suppress reduction of the reception sensitivity at a time when a metallic material is placed in the vicinity of the antenna (4).

7 Claims, 7 Drawing Sheets

U.S. PATENT DOCUMENTS

| | | | | |
|---|---|---|---|---|
| 4,362,907 | A * | 12/1982 | Polacsek | 455/345 |
| 4,439,640 | A * | 3/1984 | Takaya | 381/190 |
| 6,978,032 | B2 * | 12/2005 | Ogura et al. | 381/190 |
| 6,995,715 | B2 * | 2/2006 | Ying et al. | 343/702 |
| 7,107,016 | B2 * | 9/2006 | Dufosse et al. | 455/90.1 |
| 7,126,546 | B2 * | 10/2006 | Annamaa et al. | 343/702 |
| 7,167,130 | B2 * | 1/2007 | Hayes | 343/702 |
| 7,460,074 | B2 * | 12/2008 | Ying et al. | 343/702 |
| 7,729,721 | B2 * | 6/2010 | Kim | 455/550.1 |
| 7,750,854 | B2 * | 7/2010 | Wedel et al. | 343/702 |
| 8,111,207 | B2 * | 2/2012 | Liang et al. | 343/906 |
| 8,150,091 | B2 * | 4/2012 | Eaton et al. | 381/386 |
| 2002/0187758 | A1 * | 12/2002 | Ylitalo et al. | 455/90 |
| 2004/0171403 | A1 * | 9/2004 | Mikkola | 455/550.1 |
| 2007/0060221 | A1 * | 3/2007 | Burgan et al. | 455/575.7 |
| 2008/0019544 | A1 | 1/2008 | Ogura et al. | |
| 2009/0061966 | A1 * | 3/2009 | Yang et al. | 455/575.7 |
| 2011/0028191 | A1 * | 2/2011 | Huang et al. | 455/575.7 |

FOREIGN PATENT DOCUMENTS

| | | | |
|---|---|---|---|
| JP | 04-042700 | A | 2/1992 |
| JP | 2001-016692 | A | 1/2001 |
| JP | 3160271 | B2 | 2/2001 |
| JP | 2001-217633 | A | 8/2001 |
| JP | 2006-186881 | A | 7/2006 |
| WO | 2006/087866 | A1 | 8/2006 |

* cited by examiner

PIEZOELECTRIC SPEAKER

TECHNICAL FIELD

The present invention relates to a piezoelectric speaker suitable to be used in a stationary or mobile type electronic apparatus having at least one of a noncontact communication function, a reception function for digital television broadcasting, a short distance wireless communication function, a wireless LAN communication function and a sound output function.

BACKGROUND ART

Heretofore, a piezoelectric speaker has been known as a miniature low-current driven sound device having a piezoelectric material used as an electric acoustic transducer element. The piezoelectric speaker has been used as a sound output device of a miniature electronic apparatus (see, for example, patent literature 1). In general, a piezoelectric speaker has a structure in which a piezoelectric element, formed with an electrode of a thin silver film or the like, is attached to a metallic diaphragm. The piezoelectric speaker generates a sound in such a manner that an alternate current voltage is applied across both faces of the piezoelectric element so as to generate shape distortion on the piezoelectric element so that the metallic diaphragm to which the piezoelectric element is attached and integrated is vibrated.

The piezoelectric speaker disclosed in the patent literature 1 includes a frame, a diaphragm, a piezoelectric element provided on the diaphragm, a damper that is connected to the frame and the diaphragm and supports the diaphragm so as to allow the diaphragm to linearly vibrate, and an edge formed so as to plug an air gap among the diaphragm, the damper and the frame. The diaphragm, the damper and the edge are formed on an identical plane. The word of "linearly" means that the entire face of the diaphragm vibrates in a roughly parallel state in contrast with a drum-like action. Accordingly, an amplitude volume is increased so that reproduction of a low frequency band can be made easy.

On the other hand, a structure in which a function of a piezoelectric speaker is integrated with a function of an antenna is provided (see, for example, patent literatures 2 and 3). A selective call device disclosed in the patent literature 2 includes a wireless reception section, a piezoelectric speaker for generating an alarm sound, and an alarm sound generation section. An input terminal of the wireless reception section and a metallic base section are connected to form an antenna.

In addition, an antenna integrated with a speaker disclosed in the patent literature 3 includes a plate-like first antenna element to which a piezoelectric material is attached, a plate-like second antenna element provided away from the first antenna element at a predetermined distance, and a connection wire electrically connecting the first and second antenna elements to each other. The first and second antenna elements vibrate when a sound signal is applied to the piezoelectric material.

Patent Literature 1: JP-UM-A-1-115347

Patent Literature 2: JP-A-2001-016692 (Japanese Patent No. 3160271)

Patent Literature 3: JP-A-2006-186881

DISCLOSURE OF THE INVENTION

Problems that the Invention is to Solve

However, while the selective call device disclosed in the patent literature 2 utilizes the metallic base section of the piezoelectric speaker as the antenna, a metallic plate having a size of a generic piezoelectric type speaker as disclosed in the patent literature 2 is not able to cover frequencies in the MHz band. For example, since a digital terrestrial broadcasting (so-called one-segment broadcasting) for mobile terminals in Japan uses a frequency in 470 to 770 MHz, the above metallic plate is not applicable to electronic devices for receiving the one-segment broadcasting.

The antenna integrated with the speaker disclosed in the patent literature 3 has two antenna elements. About the second antenna element that is not provided with a piezoelectric ceramic member, the shape of the second antenna element can be changed. Therefore, by designing the size of the second antenna element so as to obtain a predetermined frequency, the antenna can cover frequencies in the MHz band. However, since the second antenna element has a plate shape, the second antenna element requires a large area in order to cover the above frequency band. Besides, in a case where the antenna is formed of two antenna elements, one of the antenna elements needs to be three-dimensionally arranged. Accordingly, space saving is not achieved and layout of components is limited.

In view of the above problems, a purpose of the invention is to provide a piezoelectric speaker which is formed in such a manner that a frame, that constitutes a part of the piezoelectric speaker and surrounds a peripheral portion of a piezoelectric element, serves as an antenna. Accordingly, a length of the antenna corresponding to the MHz frequency band is attained so as to allow the antenna to be used in the MHz band, and enlarging of the size of the piezoelectric speaker due to the frame serving as the antenna can be suppressed to a minimum level.

Means for Solving the Problems

A piezoelectric speaker of the invention includes a diaphragm, a piezoelectric element laminated on the diaphragm, and a frame that supports a peripheral portion of the piezoelectric element. At least a part of the frame is formed as an antenna.

With the above configuration, since at least a part of the frame of the piezoelectric speaker is formed as the antenna, enlarging of the size due to the piezoelectric speaker serving as the antenna can be suppressed to a minimum level. Besides, by forming the antenna in a loop shape, the antenna can cover frequencies in the MHz band.

In addition, a piezoelectric speaker of the invention includes a diaphragm and a piezoelectric element laminated on the diaphragm. An antenna is formed on a plane being identical with a plane of the piezoelectric element and is formed so as to surround the piezoelectric element.

With the above configuration, since the antenna is formed so as to surround the piezoelectric element, enlarging of the size due to the piezoelectric speaker serving as the antenna can be suppressed to a minimum level.

Besides, by forming the antenna in a loop shape, a length of the antenna can be made longer than that of a plate-like antenna so that the antenna can cover frequencies in MHz band.

In addition, in the above configuration, the antenna is supported by a magnetic material sheet.

With the above configuration, in a case where a metallic material is placed in the vicinity of the antenna, canceling of positive magnetic fluxes by a demagnetizing field generated by an eddy current can be suppressed to be low. Accordingly, even when a metallic material is placed in the vicinity of the antenna, reduction of the reception sensitivity can be suppressed to a minimum level. The above configuration is particularly effective for a case of an electromagnetic induction method used in a noncontact type IC card or the like.

In addition, in the above configuration, the antenna is a loop antenna formed in a loop shape.

With the above configuration, the antenna can cover frequencies in the MHz band such as 470 to 770 MHz, which is used for, for example, one-segment broadcasting.

Further, in the above configuration, the antenna is a plate-like antenna formed in a plate shape.

With the above configuration, space saving can be achieved. A case of the plate-like antenna is particularly effective for short distance wireless communication, wireless LAN communication or the like such as Bluetooth (registered trademark) using the GHz band. For example, in a case of 2.4 GHz, the half-wavelength is 62.5 mm. Accordingly, when a speaker unit has a size of approximately 35 mm square, two antennas can be formed by using four sides of the frame.

Further, in addition, in the above configuration, an elastic material is provided between the diaphragm and the antenna.

With the above configuration, since the elastic material works as an edge, the lowest resonant frequency can be shifted to the lower band side so as to extend a reproduction frequency band.

Moreover, a mobile communication terminal of the invention includes any one of the above piezoelectric speakers.

With the above configuration, enlarging of the size due to the piezoelectric speaker serving as the antenna can be suppressed to a minimum level. In addition, since a length of the antenna corresponding to the MHz band can be attained by forming the antenna in a loop shape surrounding the piezoelectric element, the antenna can cover frequencies in the MHz band.

Advantage Of The Invention

In accordance with the invention, the piezoelectric speaker can be also used as the antenna. The antenna can be used for frequencies in the MHz band that is used in, for example, a technical method of a noncontact IC card, as well as enlarging of the size due to use of the piezoelectric speaker also as the antenna can be suppressed to a minimum level.

DESCRIPTIONS OF THE REFERENCE NUMERALS AND SYMBOLS

Figure 1:
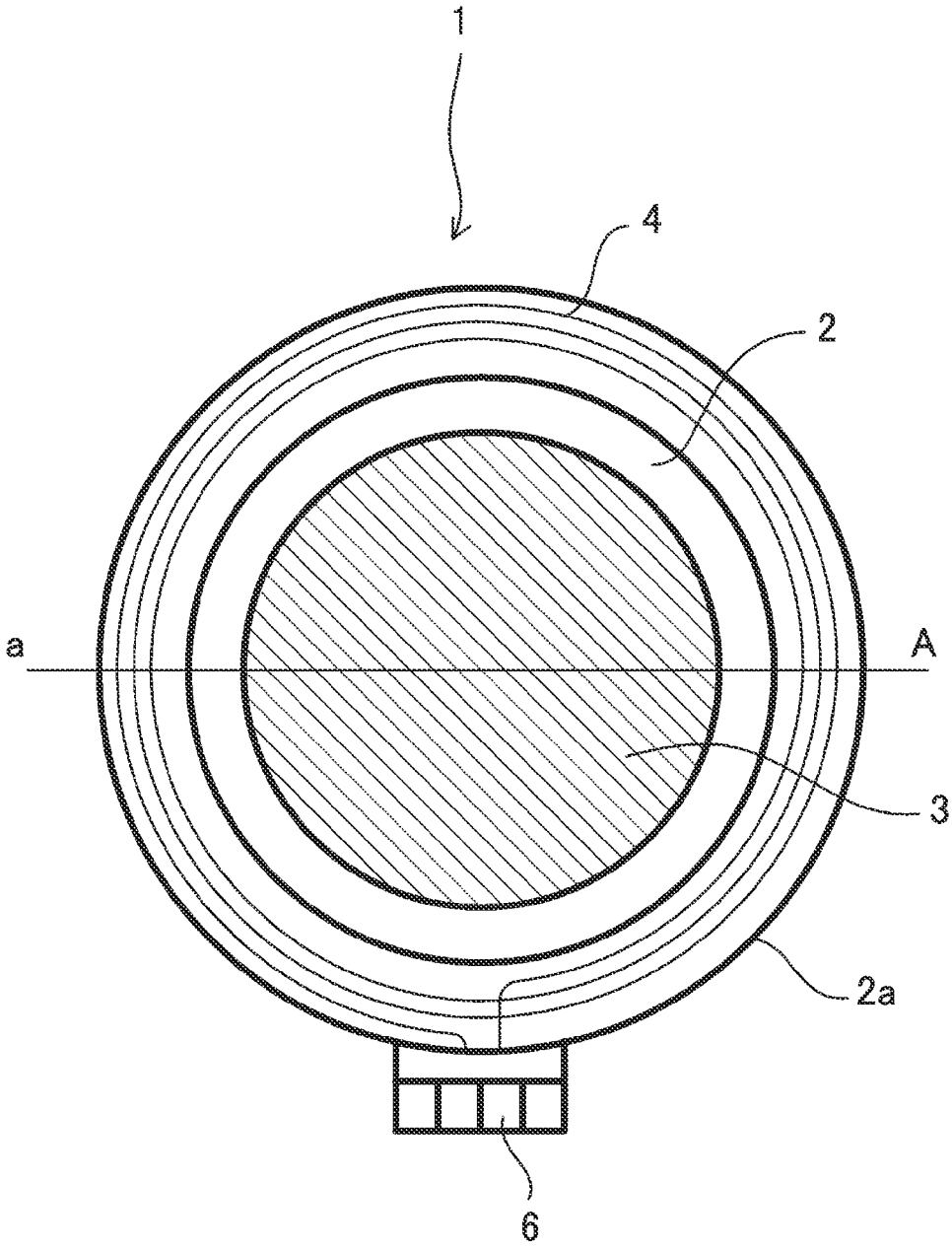
FIG. 1 is a schematic view showing a structure of a piezoelectric speaker according to a first embodiment of the invention.

1, 10, 30, 50 piezoelectric speaker
2, 11, 31, 51 diaphragm
2*a*, 12, 31*a*, 51*a* frame
3, 53 piezoelectric element
4 antenna
5 magnetic material sheet
6 input/output terminal
7 core layer
8 skin layer
13, 32, 52 edge
31*b*, 54 dumper Best Modes For Implementing The Invention Preferable embodiments of the invention will be described with reference to the accompanying drawings.

Embodiment 1

Figure 2:
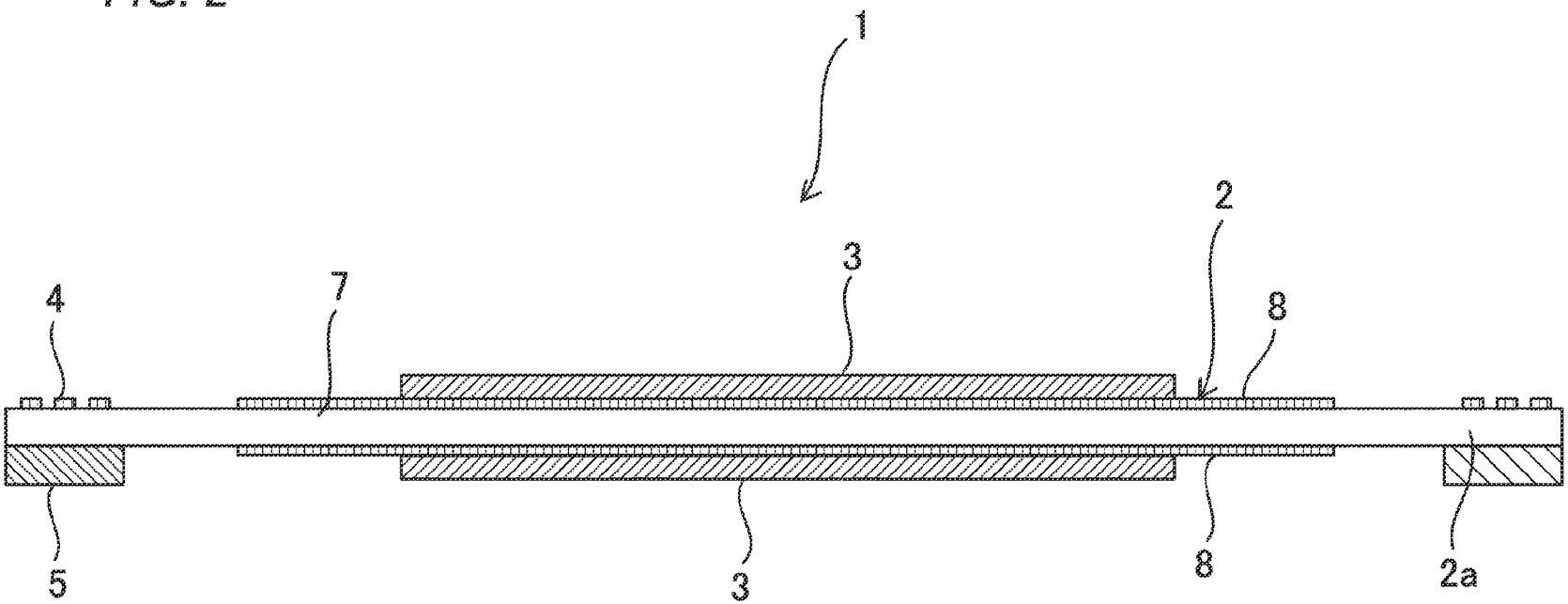
FIG. 2 is a cross sectional view taken along line a-A of the FIG. 1.

FIG. 1 is a schematic view showing a structure of a piezoelectric speaker according to a first embodiment of the invention. FIG. 2 is a cross section view taken along line a-A of FIG. 1. In FIGS. 1 and 2, a piezoelectric speaker 1 of this embodiment includes a diaphragm 2 formed in a disk shape, two piezoelectric elements 3 respectively provided on both faces of the diaphragm 2, a loop-like antenna 4 provided on a peripheral edge portion of one face of the diaphragm 2, a magnetic material sheet 5 that is made of a magnetic material and is provided on a peripheral edge portion of the other face of the diaphragm 2, and an input/output terminal 6 provided at a part of the peripheral edge portion of the diaphragm.

As shown in FIG. 2, the diaphragm 2 is mainly formed of a core layer 7 and skin layers 8 and has a lamination structure in which the core layer 7 and skin layers 8 are laminated in such a manner that the core layer 7 as an intermediate layer is sandwiched by the skin layers 8 from both faces of the core layer 7. The core layer 7 is formed of an insulation material and each of the skin layers 8 is made of a conductive material (an electrode material). While polyimide is mostly used as the insulation material constituting the core layer 7, a metamorphic material of the polyimide can be also used as the insulation material. Also, materials having insulation properties such as rubber based polymer materials (SBR, NBR, acrylonitrile, etc.), liquid crystal polymers, versatile plastic materials (polyethylene terephthalate, polycarbonate, polyarylate film, etc.) or the like can be used as the insulation material.

While a 42 alloy is mostly used as the conductive material constituting the skin layers 8, other than that stainless can be used as the conductive material. A thin film material including either any of metals such as copper, aluminum, titan, silver (silver paste) and the like, or an alloy thin film material thereof can be also used as the conductive material. In addition, a conductive thin film material obtained by applying a paste like material containing a metallic component and curing it can be used. An adhesive is mostly used for bonding of the core layer 7 with the skin layers 8.

Meanwhile, in the embodiment, a peripheral edge portion of the diaphragm 2 is referred to as a frame 2*a*. The antenna 4 is provided at one face of the frame 2*a* and the magnetic material sheet 5 is provided at the other face thereof. The two piezoelectric elements 3 form a so-called bimorph structure in which the two piezoelectric elements are attached to the diaphragm 2 in a manner to have polarization directions opposite to each other. By forming the bimorph structure, it is possible to obtain a roughly doubled deformation or a roughly doubled force as compared to a case of one piezoelectric element.

As shown in FIG. 1, the antenna 4 is a loop antenna that is wound on one face of the frame 2*a* in a plane shape. The antenna 4 is formed as a part of the skin layer 8 constituting the diaphragm 2. Since the antenna 4 is formed as the loop antenna, the antenna 4 can be used for frequencies in the MHz band, which is used in, for example, a technical method of a noncontact IC card.

The magnetic material sheet 5 is provided on the other face of the frame 2*a* so as to oppose to the antenna 4. The magnetic material sheet 5 is adapted to suppress reduction of the reception sensitivity due to influence of a demagnetizing field which may be generated when a metallic material is placed in the vicinity of the antenna 4. Namely, when a metallic material is placed in the vicinity of the antenna 4, the demagnetizing field is generated by an eddy current generated there so as to cancel positive magnetic fluxes. However, the magnetic material sheet 5 suppresses influence due to the demagnetizing field to a lower level. The input/output terminal 6 has two input terminals and two output terminals. Two piezoelectric elements 3 are connected to the input terminals and the antenna 4 is connected to the output terminals. Electrodes that connect the piezoelectric elements 3 to the input terminals of the input/output terminal 6 are formed as a part of the skin layer 8 similarly to the antenna 4. Meanwhile, the forming method of the electrodes of the piezoelectric elements 3 and the antenna 4 is the same as that in the following embodiments.

Thus, in accordance with the piezoelectric speaker 1 according to the embodiment, since the antenna 4 is provided on the frame 2*a* that is the peripheral edge portion of the diaphragm 2, the piezoelectric speaker 1 serves as the antenna and enlarging of the size can be suppressed to a minimum level. Accordingly, when the piezoelectric speaker is applied to a miniature electronic apparatus such as a mobile phone, space saving in the apparatus can be achieved. In addition, since the antenna 4 is a loop antenna, the piezoelectric speaker 1 can be used for frequencies in the MHz band, which is used in a technical method of a noncontact IC card. The piezoelectric speaker 1 can be used for frequencies in the MHz band such as 470 to 770 MHz, which is used in, for example, one-segment broadcasting. Besides, since the magnetic material sheet 5 is provided on the other face of the frame 2*a* so as to oppose to the antenna 4, it is possible to suppress reduction of the reception sensitivity at a time when a metallic material is placed in the vicinity of the antenna 4.

Embodiment 2

Figure 3:
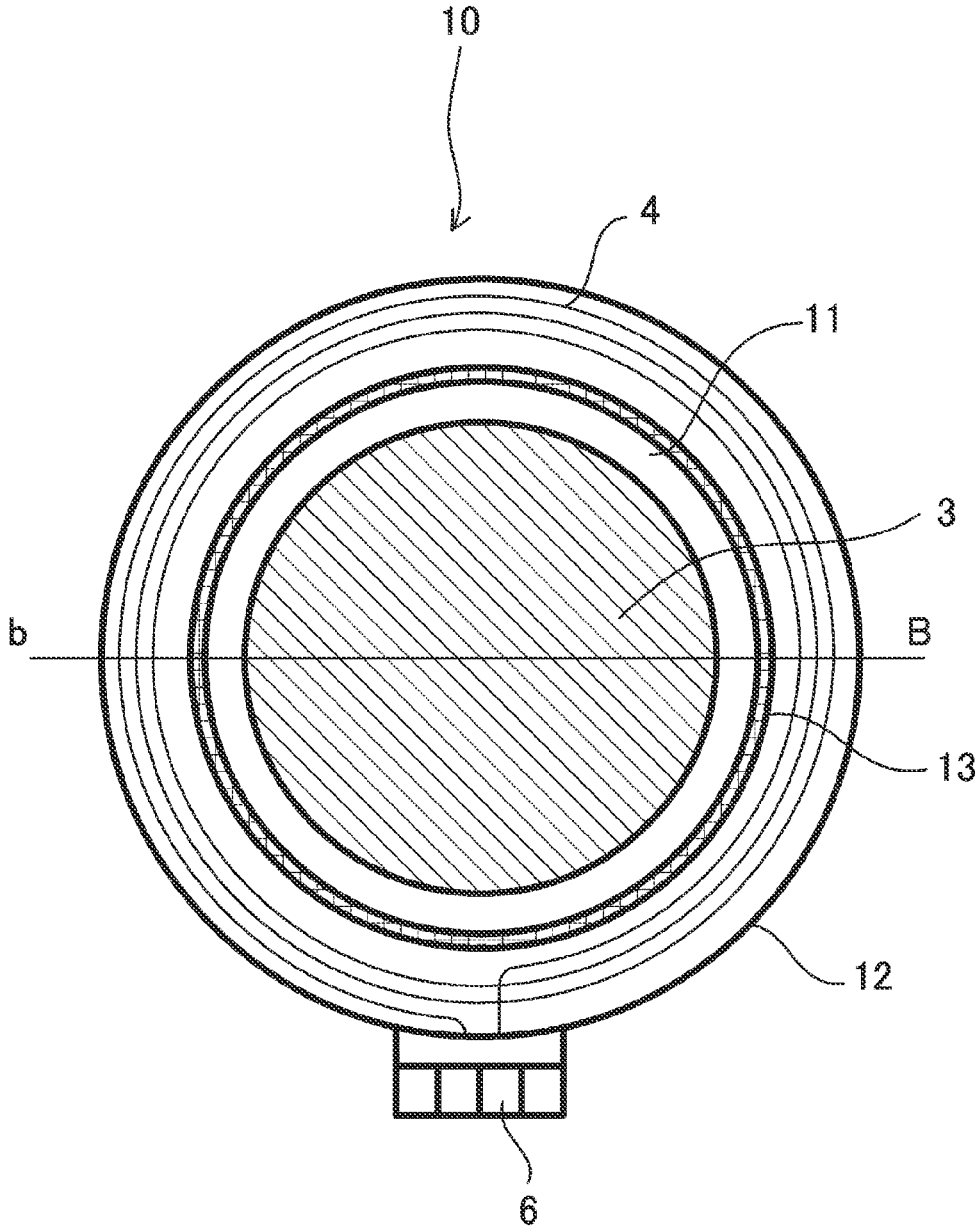
FIG. 3 is a schematic view showing a structure of the piezoelectric speaker according to a second embodiment of the invention.
Figure 4:
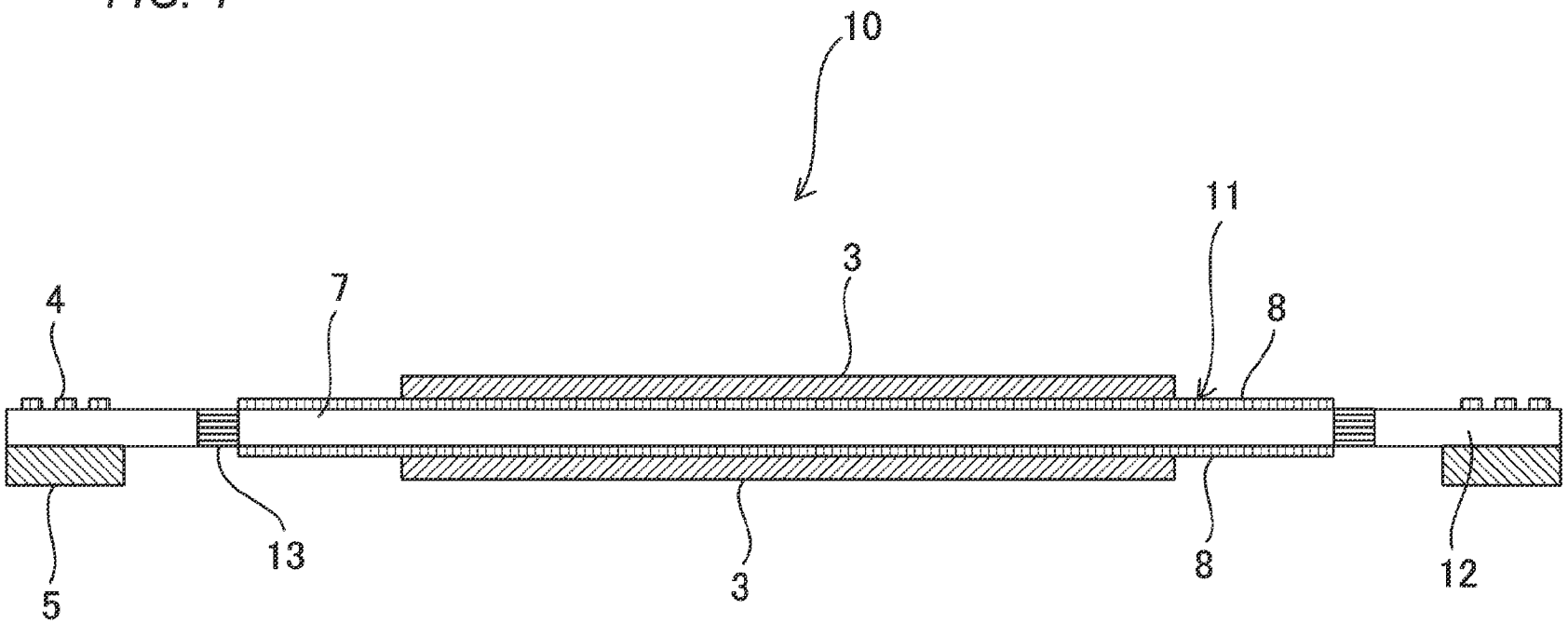
FIG. 4 is a cross sectional view taken along line b-B of the FIG. 3.

FIG. 3 is a schematic view showing a structure of a piezoelectric speaker according to a second embodiment of the invention. FIG. 4 is a cross section view taken along line b-B of FIG. 3. In FIGS. 3 and 4, the piezoelectric speaker 10 of the embodiment has a structure different from that of the piezoelectric speaker 1 according to the first embodiment in which the diaphragm and the frame constituting the antenna are integrated with each other. In this embodiment, the diaphragm and the frame are separated from each other. An edge (an elastic material) 13 is provided between a diaphragm 11 and a frame 12, which are separated from each other.

The diaphragm 11 is formed of the core layer 7 and the skin layers 8 similarly to the diaphragm 2 of the piezoelectric speaker 1 according to the first embodiment, and has a lamination structure in which the core layer 7 and skin layers 8 are laminated in such a manner that the core layer 7 as an intermediate layer is sandwiched by the skin layers 8 from both faces of the core layer 7. In addition, as an insulation material used for the core layer 7 and a conductive material (an electrode material) used for the skin layers 8, materials similar to those of the diaphragm 2 of the piezoelectric speaker 1 according to the first embodiment are used.

The frame 12 is formed in a plane ring shape of which the inner diameter is greater than the diameter of the diaphragm 11 so as to provide the edge 13 therebetween. An insulation material similar to that of the core layer 7 of the diaphragm 11 is used for the frame 12. The loop-like antenna 4 is provided on one face of the frame 12, and the magnetic material sheet 5 is provided on the other face of the frame 12 so as to oppose to face the antenna 4.

As the insulation material used for the core layer 7 of the diaphragm 11 and the frame 12, a plastic film such as PET, polycarbonate, polyimide or the like is used. The skin layers 8 of the diaphragm 11 are coated with a material having a conductivity such as a silver paste or ITO (indium tin oxide). A material, having a Young's modulus relatively lower (higher flexibility) than that of the material used for the core layer 7 of the diaphragm 11, is used for the edge 13. The material having the low Young's modules is such as a rubber based material, a soft epoxy resin, a silicone based material or the like. Forming of the edge 13 is performed in such a manner that thin films formed from the material are laminated on both faces of the diaphragm 11 and the frame 12, and an air gap between the diaphragm 11 and the frame 12 is filled with the above described material. However, it is not limited to the above process when there is a process of injecting the material to the air gap between the diaphragm 11 and the frame 12 other than the above. Since the diaphragm 11 is supported by the edge 13, a minimum resonant frequency of the diaphragm 11 can be shifted to the low frequency band side, thereby extending the reproduction frequency band.

Thus, in accordance with the piezoelectric speaker 10 according to the embodiment, since the diaphragm 11 and the frame 12 are separated from one another and the edge 13 made of the material having a low Young's modulus such as a rubber based material, a soft epoxy resin, a silicone based material or the like is provided therebetween, the reproduction frequency band can be extended and the sound characteristic can be improved. In addition, since the antenna 4 is provided on the frame 12 similarly to the piezoelectric speaker 1 of the first embodiment, the piezoelectric speaker 10 serves as the antenna, enlarging of the size can be suppressed to a minimum level, and it is possible to achieve space saving in a miniature electronic apparatus such as a mobile phone or the like to which the piezoelectric speaker 1 is adopted. Further, since the antenna 4 is the loop antenna, the piezoelectric speaker 10 can be used for frequencies in the MHz band used in a noncontact IC card technology. Also, the piezoelectric speaker 10 can be used for frequencies in the MHz band such as 470 to 770 MHz, which is used in, for example, one-segment broadcasting. Moreover, since the magnetic material sheet 5 is provided on the other face of the frame 12 so as to oppose to the antenna 4, it is possible to suppress reduction of the reception sensitivity at a time when a metallic material is placed in the vicinity of the antenna 4, particularly in a case where the antenna is used in electromagnetic induction type noncontact communication.

Embodiment 3

Figure 5:
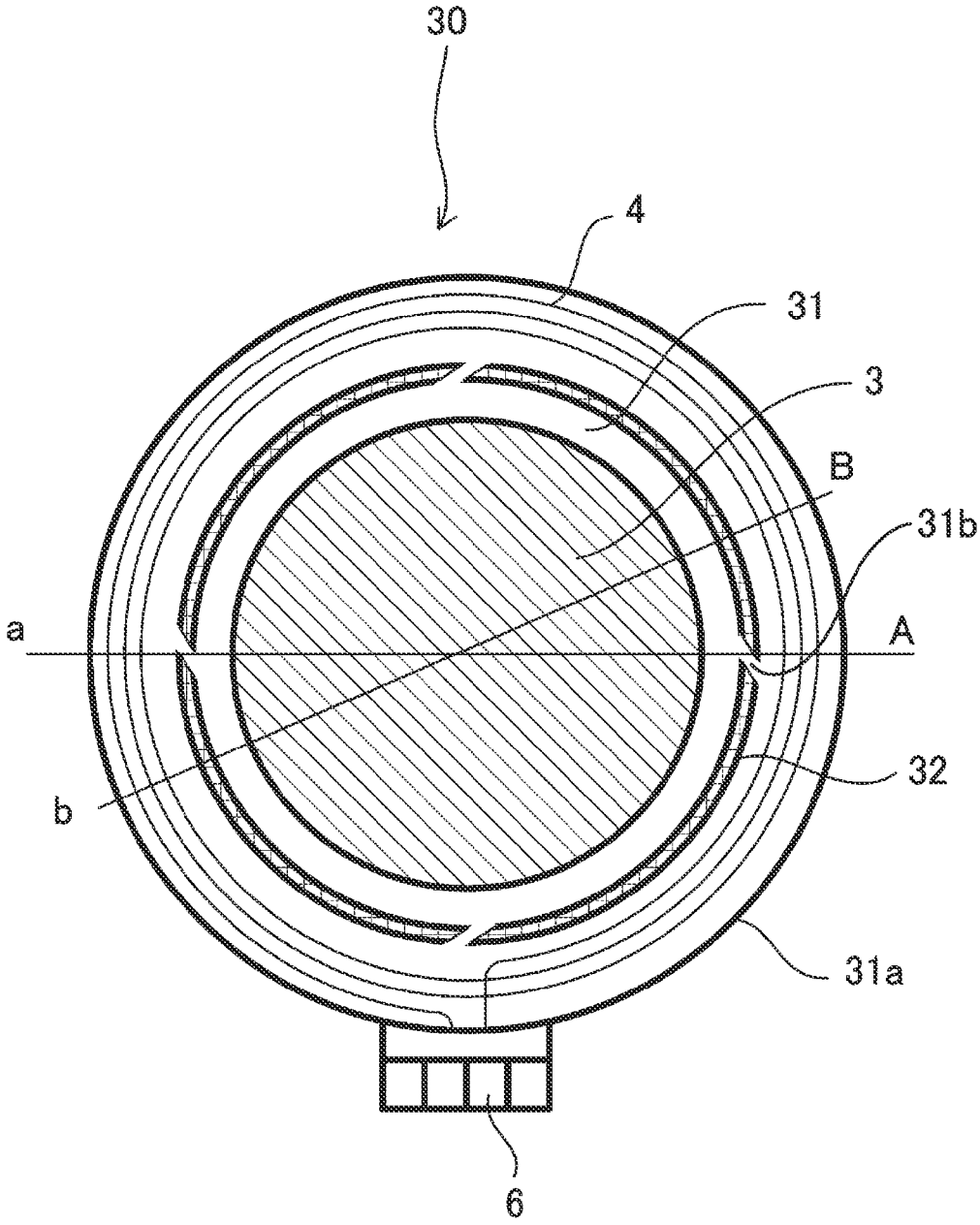
FIG. 5 is a schematic view showing a structure of the piezoelectric speaker according to a third embodiment of the invention.

FIG. 5 is a schematic view showing a structure of a piezoelectric speaker according to a third embodiment of the invention. A cross sectional view taken along line a-A of FIG. 5 is the same as in FIG. 2 and a cross sectional view taken along line b-B of FIG. 5 is the same as in FIG. 4. As shown in FIGS. 5, 2 and 4, the piezoelectric speaker 30 of the embodiment is formed such that the diaphragm and the frame are integrated with each other and a plurality of arc shaped edges 32 are arranged at equal intervals along a circumferential direction at portions between the diaphragm 31 and the frame 31*a* that is the peripheral edge portion of the diaphragm 31. The edges 32 are obtained in such a manner that air gaps are formed by punching, in arc shaped regions, the core layer 7 produced by an etching process, and the air gaps are filled with a resin such as polymer having an adequate flexibility. Portions except the air gaps for forming the edges 32 are made to be dumpers 31*b*.

Since the diaphragm 11 and the frame 12 are separated from each other in the second embodiment, axes of the diaphragm 11 and the frame 12 need to be aligned when forming the edge 13. However, since the diaphragm 31 and the frame 31*a* are integrated with each other in this embodiment, it is not necessary to perform aligning of the axes of the diaphragm 31 and the frame 31*a*, thereby facilitating the forming. The loop-like antenna 4 is provided on one face of the frame 31*a* and the magnetic material sheet 5 is provided on the other face of the frame 31*a* so as to oppose to the antenna 4.

Thus, in accordance with the piezoelectric speaker 30 according to the embodiment, since the plurality of arc shaped edges 32 are arranged along the circumferential direction at the portions between the diaphragm 31 and the frame 31*a* that is the peripheral edge portion of the diaphragm 31, the reproduction frequency band can be extended and the sound characteristic can be improved. In addition, since the antenna 4 is provided on the frame 31*a* similarly to the piezoelectric speaker 1 of the first embodiment, the piezoelectric speaker 1 serves as the antenna, enlarging of the size can be suppressed to a minimum level, and it is possible to achieve space saving in a miniature electronic apparatus such as a mobile phone or the like to which the piezoelectric speaker 1 is adopted. Further, since the antenna 4 is formed in the loop shape surrounding the piezoelectric element and the length of the antenna is attained, the piezoelectric speaker can be used for frequencies in the MHz band used in a noncontact IC card technology. Also, it can be used for frequencies in the MHz band such as 470 to 770 MHz, which is used in, for example, one-segment broadcasting. Moreover, since the magnetic material sheet 5 is provided on the other face of the frame 31*a* so as to oppose to the antenna 4, it is possible to suppress reduction of the reception sensitivity at a time when a metallic material is placed in the vicinity of the antenna 4.

Embodiment 4

Figure 6:
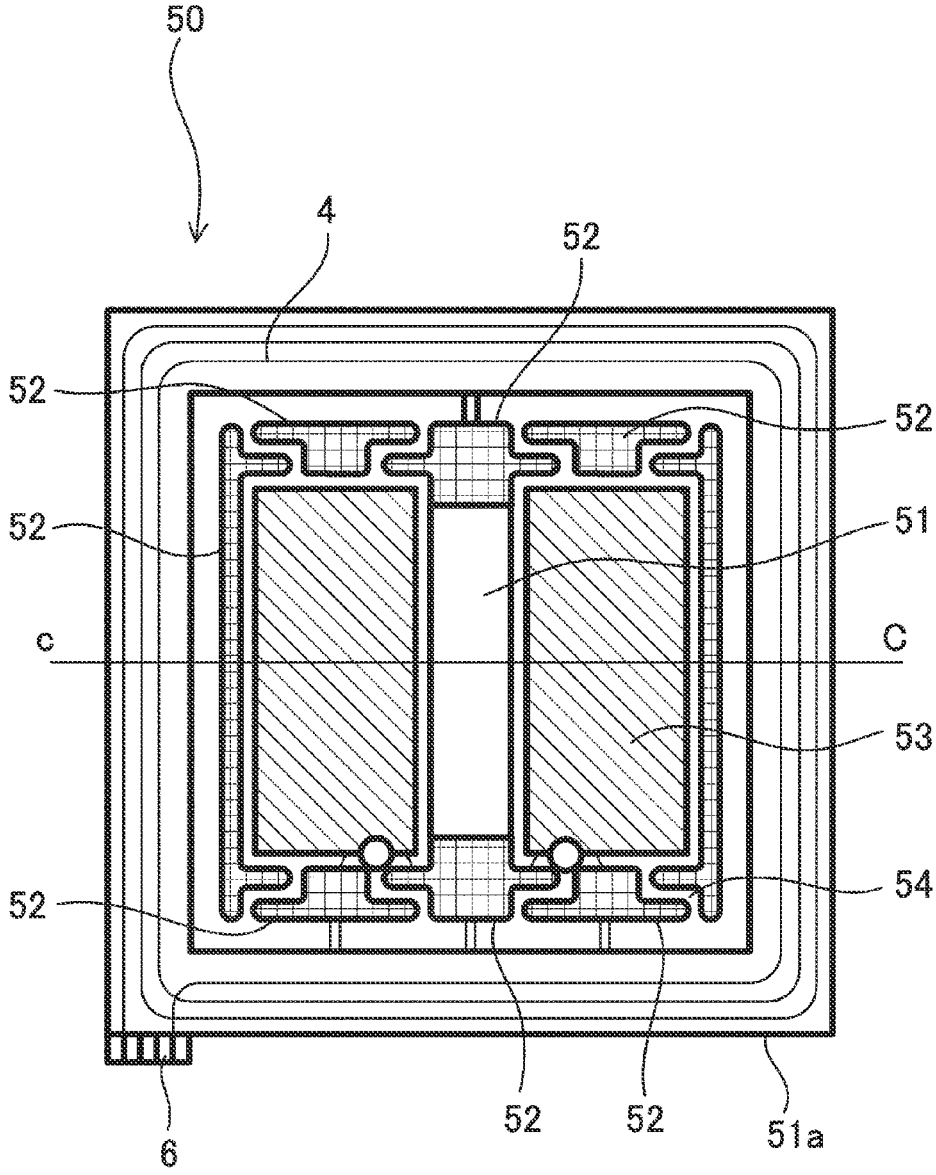
FIG. 6 is a schematic view showing a structure of the piezoelectric speaker according to a fourth embodiment of the invention.
Figure 7:
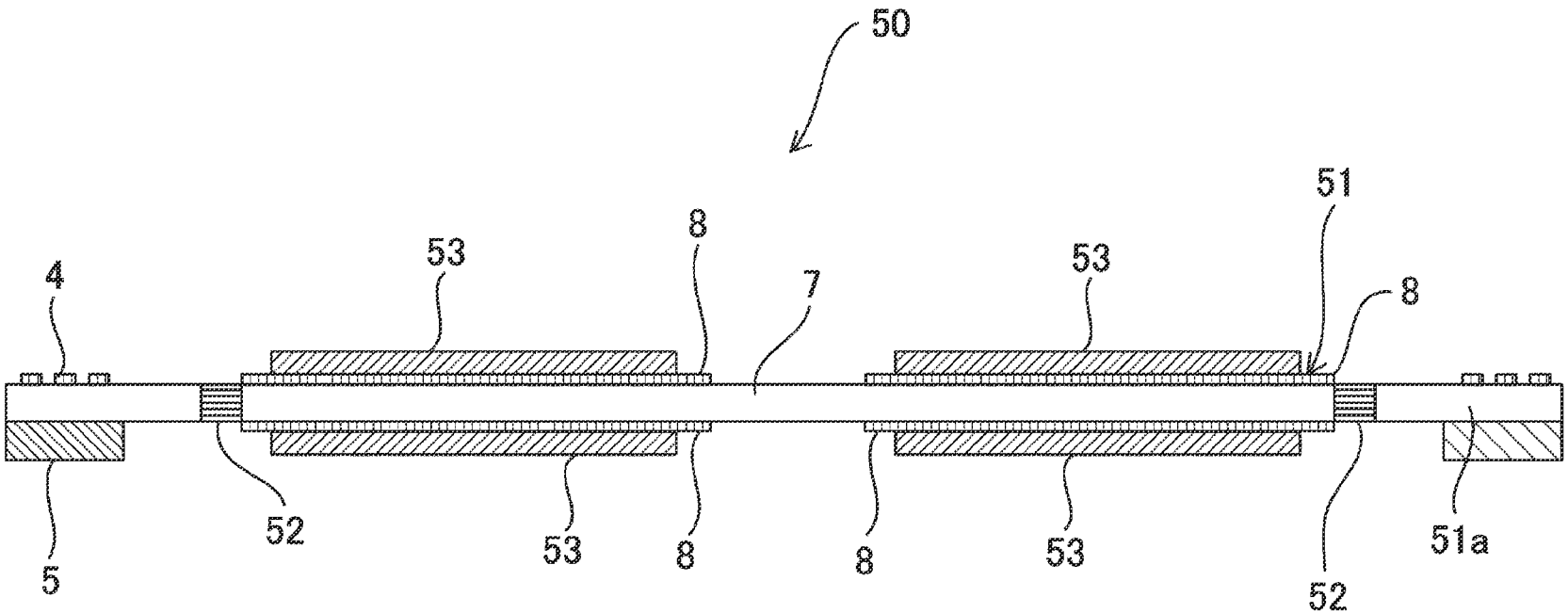
FIG. 7 is a cross sectional view taken along line c-C of the FIG. 6.

FIG. 6 is a schematic view showing a structure of a piezoelectric speaker according to a fourth embodiment of the invention. FIG. 7 is a cross sectional view taken along line c-C of FIG. 6. As shown in FIGS. 6 and 7, the piezoelectric speaker 50 of the embodiment is constituted such that the diaphragm and the frame constituting the antenna are not integrated with each other and are separated from each other similarly to the piezoelectric speaker 10 according to the second embodiment. Edges 52 are provided between the diaphragm 51 and the frame 51*a* that are separated from each other. In addition, the piezoelectric speaker 50 according to the embodiment has two sets of piezoelectric elements 53 that are formed to have a bimorph structure.

As shown in FIG. 6, a plurality set of the edges 52 having the same shapes are arranged along the periphery of the diaphragm 51. Forming of the edges 52 is carried out, similarly to that for the piezoelectric speaker 30 of the third embodiment, in such a manner that air gaps are formed by punching the core layer 7 produced by an etching process, and the air gaps are filled with a resin such as a polymer having an adequate flexibility. Portions except the air gaps for forming the edges 52 are made to be dumpers 54. The diaphragm 51 is supported to the frame 51*a* by the edges 52 and the dampers 54.

Each of piezoelectric elements 53 is formed in a rectangular shape having a size one fourth or less of that of the diaphragm 51, and the piezoelectric elements 53 are respectively arranged on both faces of the diaphragm 51 so as to be separated from each other. In the above case, in order to form the bimorph structure, the piezoelectric elements 53 at one face of the diaphragm 51 and the piezoelectric elements 53 at the other face of the diaphragm are arranged so as to be opposed. The piezoelectric speaker 50 according to this embodiment includes two sets of piezoelectric elements 53 formed to have the bimorph structure. Meanwhile, the shapes of the diaphragm 51, edge 52, piezoelectric elements 53 and dampers 54, and the materials or the like respectively used therefor are described in detail in a prior art document (WO2006/087866A1) applied by the applicant of this invention.

The loop-like antenna 4 is provided on one face of the frame 51 that is the peripheral edge portion of the diaphragm 51, and the magnetic material sheet 5 is provided on the other face of the frame 51*a* so as to oppose to the antenna 4.

Thus, in accordance with the piezoelectric speaker 50 according to the embodiment, since the plurality of edges 52 are arranged along the periphery of the diaphragm 51, the reproduction frequency band can be extended and the sound characteristic can be improved. In addition, since the antenna 4 is provided on the frame 51*a* similarly to the piezoelectric speaker 1 of the first embodiment, the piezoelectric speaker 50 serves as the antenna, enlarging of the size can be suppressed to a minimum level, and it is possible to achieve space saving in a miniature electronic apparatus such as a mobile phone or the like to which the piezoelectric speaker 50 is adopted. Further, since the antenna 4 is formed in the loop shape surrounding the piezoelectric elements and the length of the antenna is attained, the piezoelectric speaker 50 can be used for frequencies in the MHz band, which is used in a noncontact IC card technology. Also, the piezoelectric speaker 50 can be used for frequencies in the MHz band such as 470 to 770 MHz, which is used in, for example, one-segment broadcasting. Moreover, since the magnetic material sheet 5 is provided on the other face of the frame 51*a* in a manner to face the antenna 4, it is possible to suppress reduction of the reception sensitivity at a time when a metallic material is placed in the vicinity of the antenna 4.

In the piezoelectric speaker of the invention, the shape is not limited to that in the above first to fourth embodiments. The piezoelectric speaker can take any shape as long as it has the frame that supports the diaphragm.

While the invention has been described in detail with reference to the specific embodiments, it should be understood by those skilled in the art that various changes or modifications may be made without departing from the spirit and scope of the invention.

This application is based on Japanese Patent Application (JP-2008-027570) filed on Feb. 7, 2008, and the subject matter of which are incorporated herein by reference.

INDUSTRIAL APPLICABILITY

This invention has an effect that the piezoelectric speaker can serves as the antenna, can be used for frequencies in the MHz band that is used in, for example, a noncontact IC card, as well as enlarging of the size due to use of the piezoelectric speaker also as the antenna can be suppressed to a minimum level. The invention can be adopted to a stationary or mobile type miniature electronic apparatus having at least one of a noncontact communication function, a reception function for digital television broadcasting, a short distance wireless communication function, a wireless LAN communication function and a sound output function.

The invention claimed is:

1. A piezoelectric speaker, comprising:

a diaphragm having a first face and a second face opposite the first face;

at least one piezoelectric element that is laminated on the first face of the diaphragm;

an antenna formed on the first face of the diaphragm to surround the at least one piezoelectric element; and a magnetic material sheet provided on the second face of the diaphragm opposite the antenna on the first face.

2. The piezoelectric speaker according to claim 1, wherein the antenna is a loop antenna formed in a loop shape.

3. The piezoelectric speaker according to claim 1, wherein the antenna is a plate-like antenna formed in a plate shape.

4. The piezoelectric speaker according to claim 1, wherein an elastic member is provided between the diaphragm and the antenna.

5. A mobile communication terminal, comprising:

the piezoelectric speaker according to claim 1.

6. The piezoelectric speaker according to claim 1, wherein the antenna is a loop antenna formed at a peripheral edge portion on the first face of the diaphragm and includes multiple revolutions that surround the at least one piezoelectric element.

7. The piezoelectric speaker according to claim 1, wherein the magnetic material sheet has an annular shape and is provided on the second face of the diaphragm so as to oppose the antenna.

* * * * *